US006070278A

United States Patent [19]

Smith

[11] Patent Number: 6,070,278

[45] **Date of Patent: *Jun. 6, 2000**

[54] HYDRAULIC POWERED CHAIR LIFT

[76] Inventor: Craig D. Smith, 12706 St. Clair Dr., Middletown, Ky. 40243

[ * ] Notice: This patent issued on a continued prosecution application filed under 37 CFR 1.53(d), and is subject to the twenty year patent term provisions of 35 U.S.C. 154(a)(2).

[21] Appl. No.: 09/044,299

[22] Filed: Mar. 19, 1998

Related U.S. Application Data

[60] Provisional application No. 60/041,356, Mar. 21, 1997.

[51] Int. Cl.[7] ..... E04H 4/00

[52] U.S. Cl. ..... 4/496; 4/563.1; 4/560.1

[58] Field of Search ..... 4/496, 560.1, 561.1, 4/562.1, 563.1, 559, 604

[56] References Cited

U.S. PATENT DOCUMENTS

| | | | |
|---|---|---|---|
| 4,183,106 | 1/1980 | Grimes et al. | 4/496 |
| 4,941,216 | 7/1990 | Boublil | 4/496 |
| 4,996,728 | 3/1991 | Nolan . | |
| 4,998,305 | 3/1991 | Davis | 4/604 |
| 5,218,727 | 6/1993 | Krumbeck . | |
| 5,303,637 | 4/1994 | Nolan . | |
| 5,367,721 | 11/1994 | Boyles . | |
| 5,465,433 | 11/1995 | Nolan . | |
| 5,572,921 | 11/1996 | Krumbeck . | |
| 5,715,545 | 2/1998 | Forwick | 4/563.1 |

*Primary Examiner*—David J. Walczak
*Attorney, Agent, or Firm*—Middleton & Reutlinger; John F. Salazar

[57] ABSTRACT

A hydraulic chair lift for a pool or other body of water. The present hydraulic chair lift utilizes standard faucet water pressure to raise and lower the seat. The entire chair lift assembly is rotatable about a single point for easy loading and unloading of a passenger on the chair assembly. The rotation assembly also allows the user to lock the chair in a particular position. The support and cylinder assembly is comprised of an upwardly extending support bar which is clamped to a cylinder assembly. The cylinder assembly itself is attached to the water source. The cylinder assembly additionally has a floating cylinder which rises and lowers by pressure applied to an upper rubber seal. The entire cylinder assembly is prevented from rotating by a key lock system wherein the key enters directly into the piston rod. The chair assembly is attached to the lowest point of the piston rod.

19 Claims, 9 Drawing Sheets

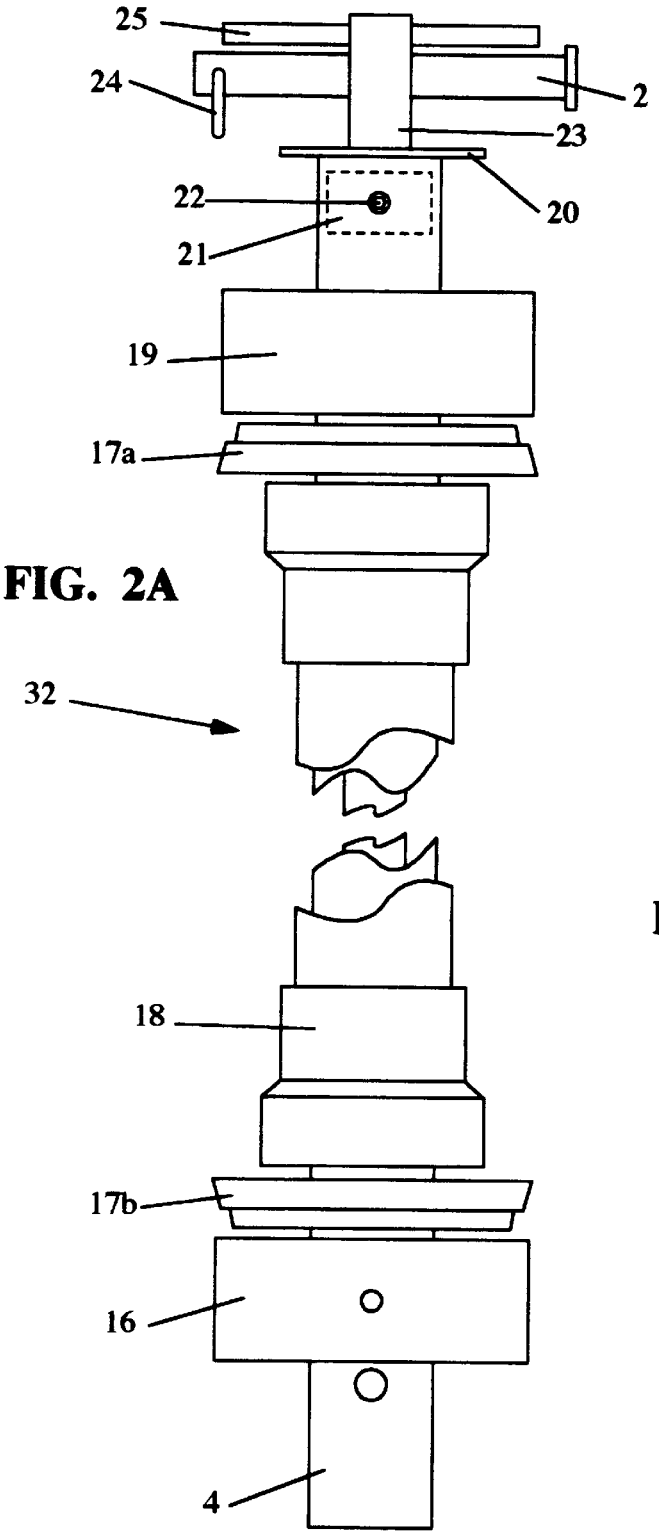
FIG. 2A
FIG. 2B
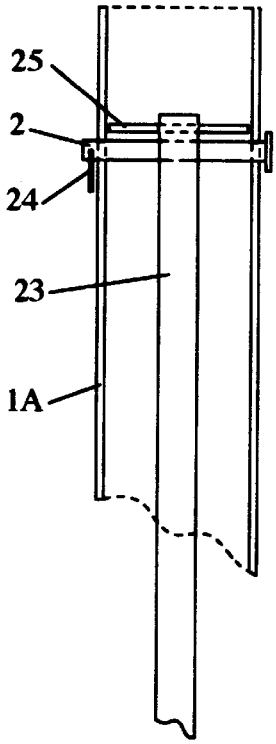
FIG. 2C
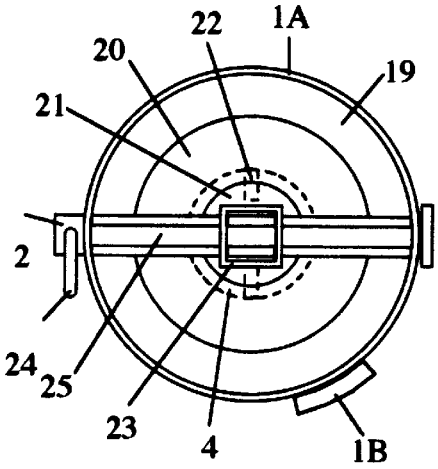

FIG. 3A
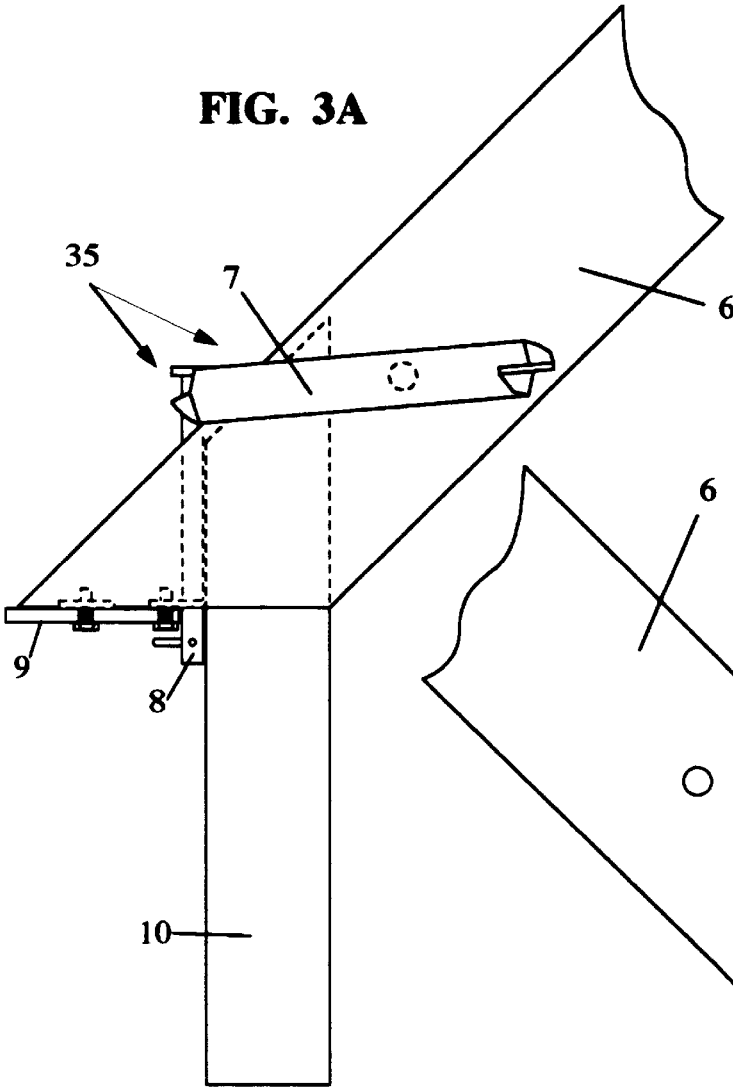
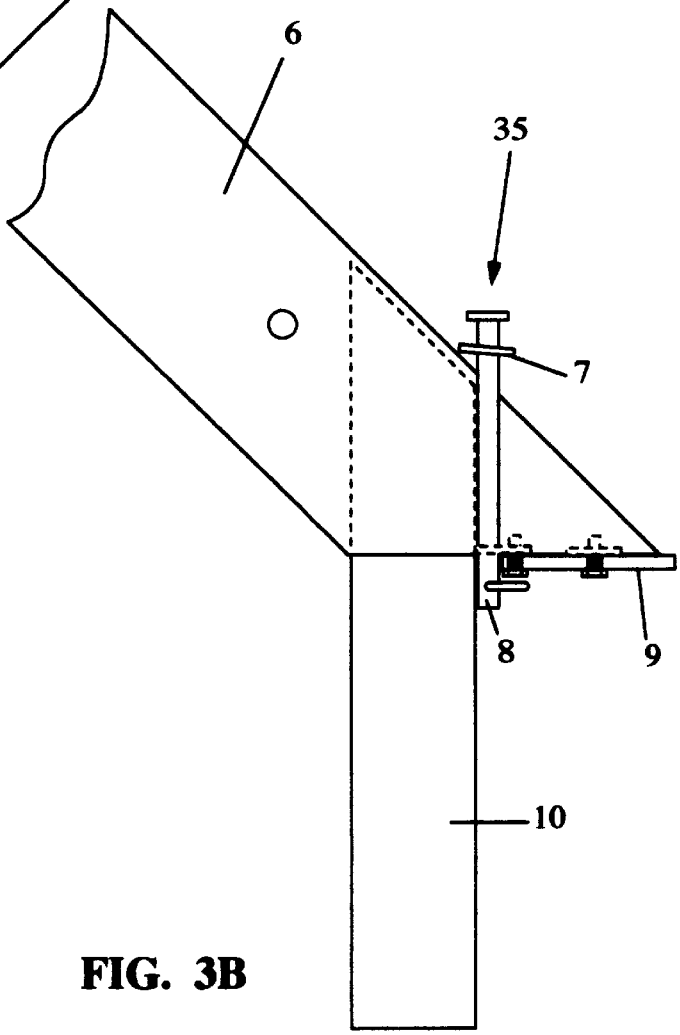
FIG. 3B

FIG. 4A
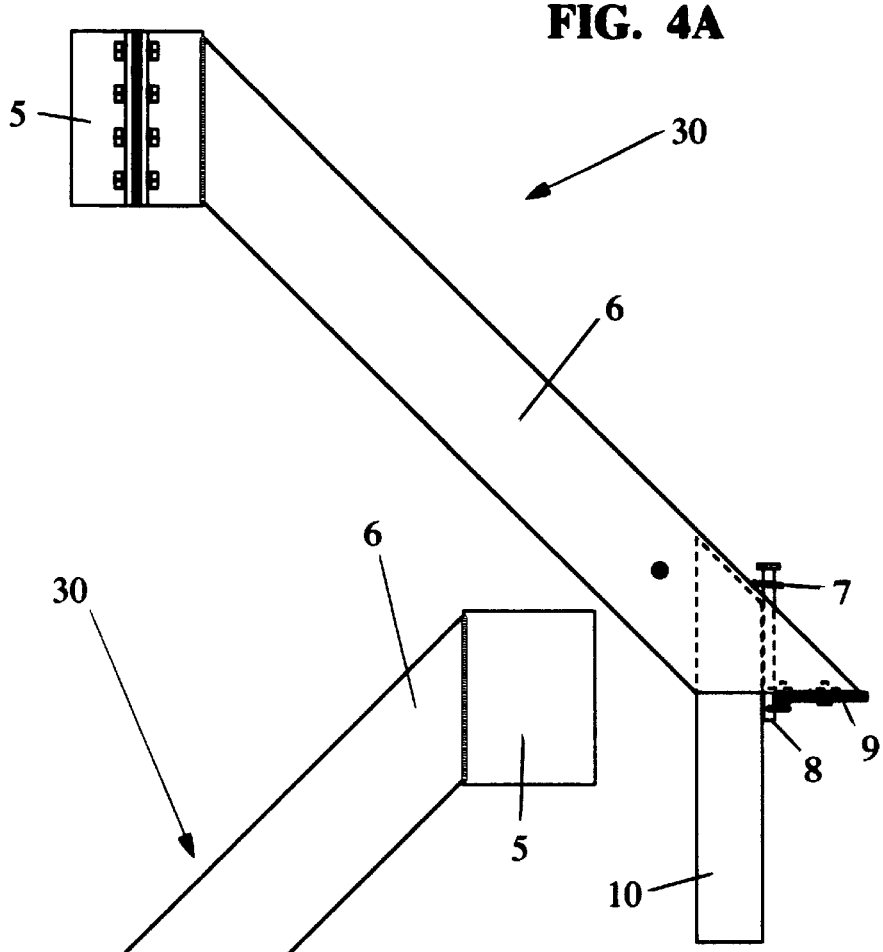
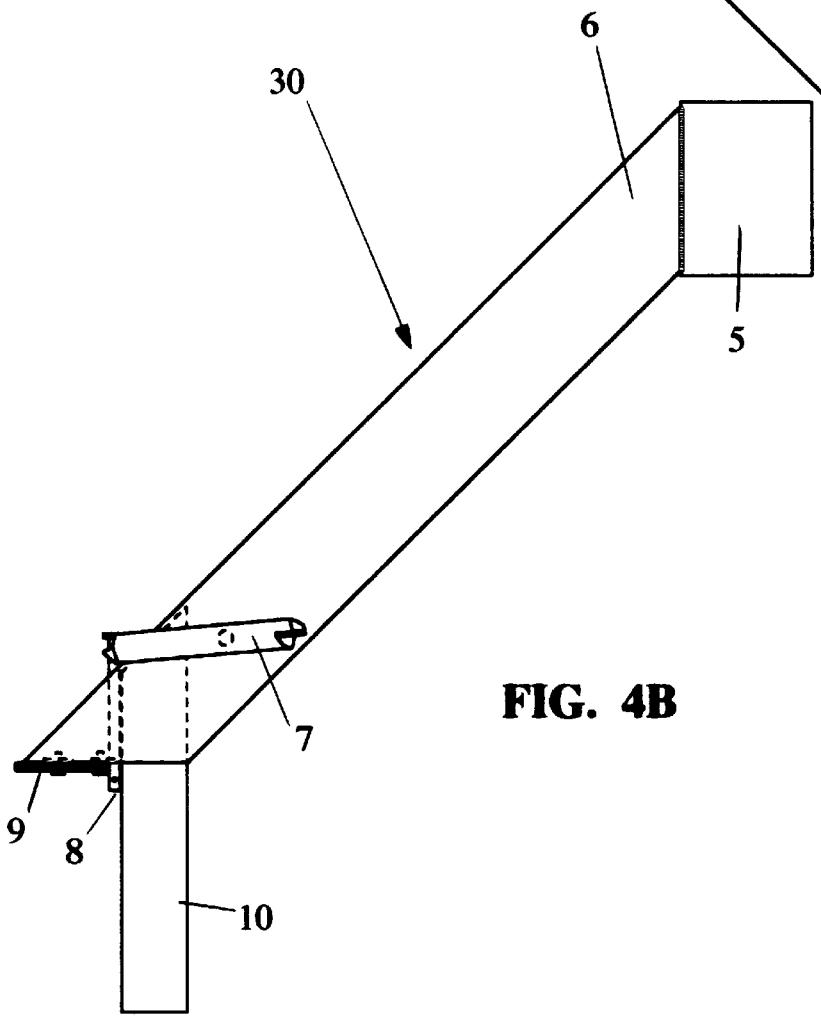
FIG. 4B

HYDRAULIC POWERED CHAIR LIFT

This application claims the benefit of U.S. Provisional No. 60/041,356 filed Mar. 21, 1997.

BACKGROUND OF THE INVENTION

1. Field of the Invention

The present invention deals with water powered chair lifts for use in pools, lakes and other bodies of water.

2. Discussion of the Prior Art

The water powered cylinder concept has been around for many years and has many designs of its internal components and applications of the cylinder. The water powered cylinder has been used in a variety of handicapped/disabled lifts as well. The new lift assembly primarily provides but not limited to providing a disabled person access from a deck surface, dock, boat, or most areas surrounding a body of water into a body of water such as a pool, spa, lake, river, etc., from one location and level to another and access back out from the body of water. The lift assembly obtains its power from a common water connection to a typical city water system, cistern, well, fixed or portable pump system, etc.

SUMMARY OF THE INVENTION

The present invention is for a new design of a hydraulic powered chair lift with improvements regarding safety, simplicity of construction, structural strength, and solutions to short comings of past designs. The current invention consists of very few parts in comparison to other lifting products. The current invention's structure provides a low center of gravity leverage point with the cylinder in a vertical position which provides a rigid low flexing one piece structure that does not require folding nor disassembly to be moved in a portable fashion. The current invention also incorporates a rotation locking device which solves the problem of past designs of the seat or platform moving away from the user when getting onto or off from the seat or platform over the deck and in the water by locking the lift assembly into position over the deck and the water. The rotation anchor point of the chair lift, the socket, is fitted with a bearing sleeve for smoother less binding rotation and also contributes to the rotation lock feature in most installations. Past designs have a metal to metal contact during rotation. The support structure is not permanently attached to the cylinder which allows for vertical adjustment and lower costs for service and cylinder or structure replacement if either item is damaged. The piston rod is constructed with a retaining system which is secured to the piston rod in a manner which forms a one piece part. The seat bracket tube allows for the connection to the piston rod and accommodates accessories and options such as a foot rest, arm rest, multi-position adjustable seat, a head rest, and other items for custom built applications.

Finally, the present invention comprises an a hydraulic chair lift, comprising, an upwardly extending support beam affixed at one end to a vertically extending cylinder assembly, said support beam affixed to the ground at the opposite end; a piston rod movably retained within said cylinder assembly; a seat assembly attached to said piston rod; and, valve means affixed to said cylinder assembly. The present invention is additionally comprised of a hydraulic chair lift which further has a rotation lock mechanism for preventing said support beam from rotating when said lock mechanism is engaged, the rotation lock mechanism being comprised of a pivoting control pivotally attached to said support beam; a lock pin attached to one end of said pivoting control; wherein said socket bearing is further comprised of notches which receive said lock pin to retain said support beam in position.

BRIEF DESCRIPTION OF THE DRAWINGS

A better understanding of the invention will be had upon reference to the following description in conjunction with the accompanying drawings in which like numerals refer to like parts and wherein:

FIG. 2A is a detail of the piston rod assembly of the present invention with the key pin;

FIG. 2B shows the front view of and the assembly of the key, centering rod, key pin, and cylinder of FIG. 2A;

FIG. 2C is a top view of the cylinder assembly shown in FIG. 2A;

FIG. 3A is a view of the front side of the lower area of the support beam assembly of FIG. 1 and of the rotation lock assembly of the present invention;

FIG. 3B is a view of the rear side of the lower area of the support beam assembly shown in FIG. 1;

FIG. 4A shows rear side of the support beam assembly of the present invention;

FIG. 4B shows front side of the support beam assembly of the present invention;

DETAILED DESCRIPTION OF THE PREFERRED EMBODIMENT

THE LIFT ASSEMBLY—(FIG. 1) The lift assembly 33 is designed to transfer people or objects into and out of water such as swimming pools, therapy pools, spas, lakes, or any other body of water or from one location level and position to another in other environments. The lift's power is provided by a connection to a water source such as a water faucet or other similar hook up.

Figure 5:
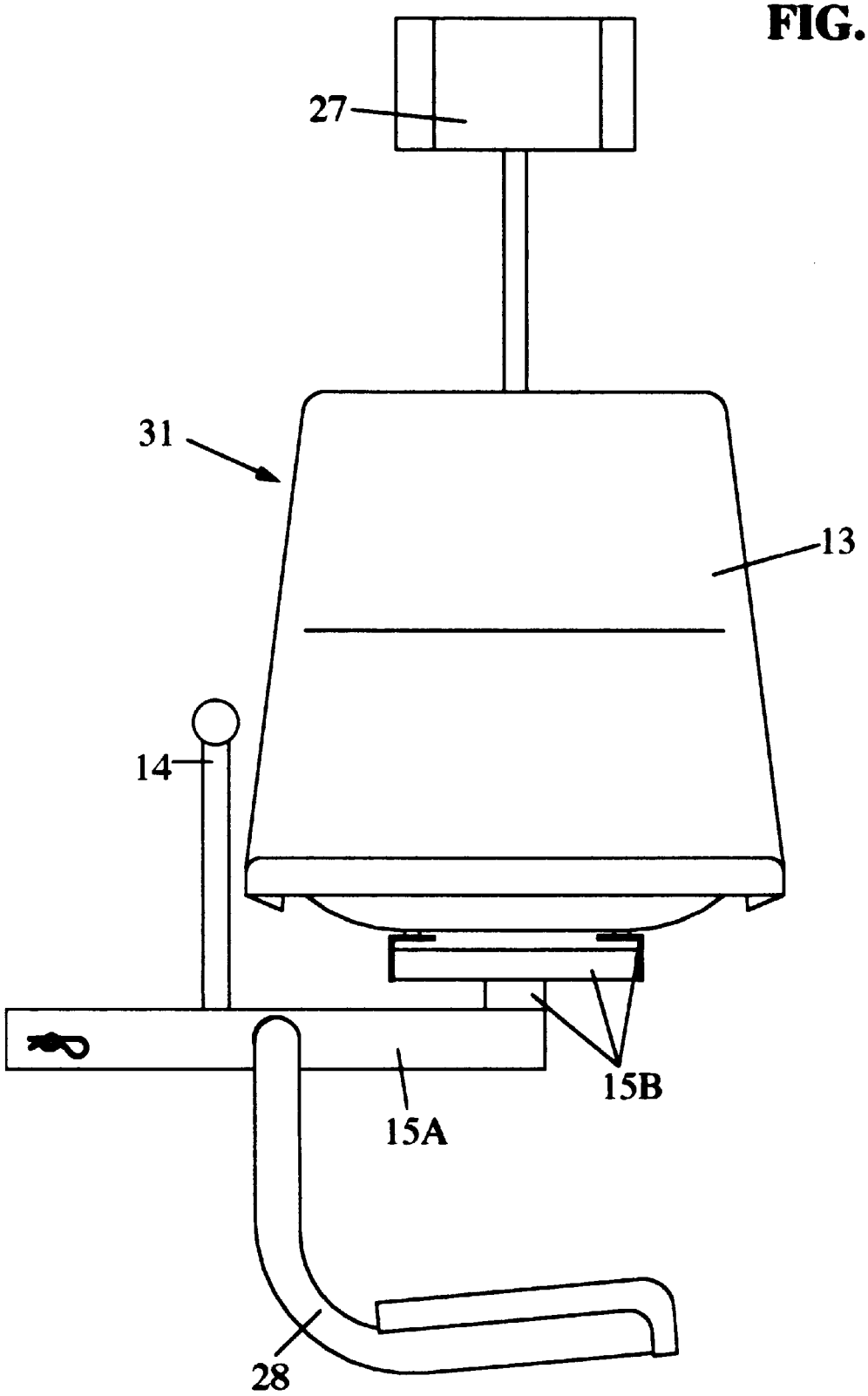
FIG. 5 shows the seat assembly of the present invention with the optional head and foot rests.

LIFT SUPPORT BEAM ASSEMBLY—(FIGS. 1, 3A, 3B, 4A & 4B) The support beam assembly 30 is constructed with stainless steel or other similar alloys. The lift support beam assembly 30 is made up of a tube or post 10 which is inserted into the ground or other support. The tube 10 joins the base end of the support beam 6 which is connected at the opposite end to the cylinder clamp 5. The cylinder clamp 5 clamps the cylinder 1A near the cylinder 1A base in, but not limited to, an area that is between the piston 19 and the guide 16 "travel zone". The "travel zone" is the area in the cylinder 1A that the piston 19 and the guide 16 do not pass through during lift operation which prevents the clamp 5 from distorting the cylinder 1A in an area which could cause a leak and or binding of the internal mechanism. The clamp 5 location provides a low leverage point for the lift assembly 33 which reduces the amount of flex spring in the lift assembly 33. The clamping of the lift support beam assembly 30 to the cylinder 1A rather than permanently attaching (such as welding) the support beam assembly 30 to the cylinder 1A allows the cylinder 1A to be removed for service or replacement in the event the cylinder 1A becomes damaged. In the case of permanently attaching the support beam assembly 30 to the cylinder 1A, the need to replace the entire lift assembly, less the cylinder internals which consists of the piston rod assembly 32 (FIG. 2) and seat assembly 31 (FIGS. 1 & 5) would be required and would increase service costs to the user. The clamp 5 also provides a range of up and down seat 13 height adjustment by raising and lowering the cylinder 1A.

The valve plate 1B, which is attached on the cylinder 1A, provides a safety catch, by preventing the cylinder 1A from slipping through the clamp 5 in the event the clamp 5 became loose or was not tightened correctly. Fixtures other than the valve plate 1B may also be affixed to the cylinder 1A to serve the same purpose.

Figure 1:
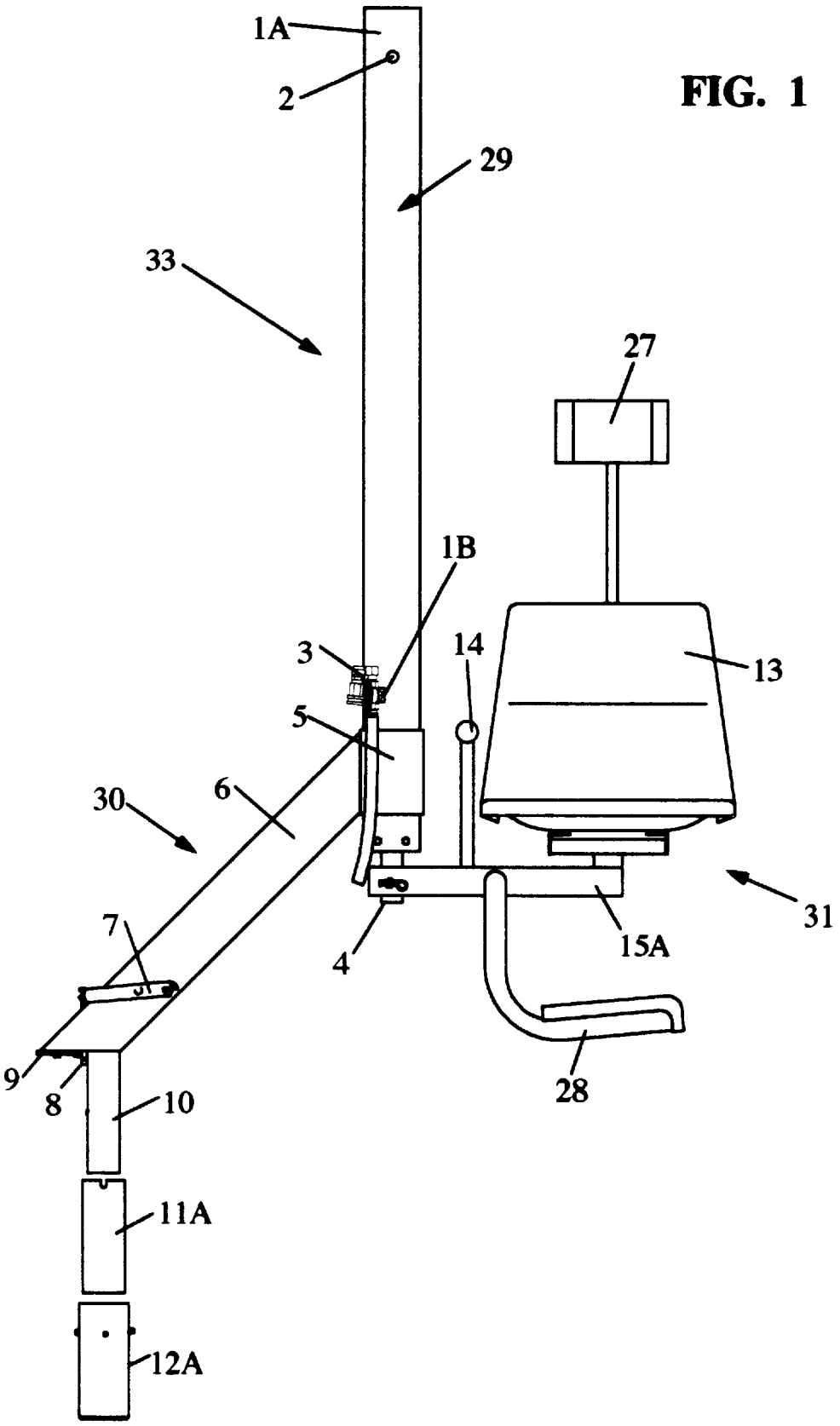
FIG. 1 shows the hydraulic chair lift assembly of the present invention.

The post 10 is placed into the socket base assembly 34 which provides the point for rotation and rotation locking for the lift assembly 33 (FIG. 1). The support beam assembly 30 base area also contains the rotation lock mechanism 7,8, also referred to as the rotation lock assembly 35, and is made up of a pivoting hand/foot operating control 7 which activates the lock pin 8 up and down. Pin 8 passes through and down into and protrudes through the bottom side of the support beam 6 of sufficient distance to drop into the notches 11B in the top end of the socket bearing 11A. The bottom end of the support beam 6 is fitted with a pad 9 to offer cushioning protection against contact with the bottom edge of the support beam 6.

Figure 3D:
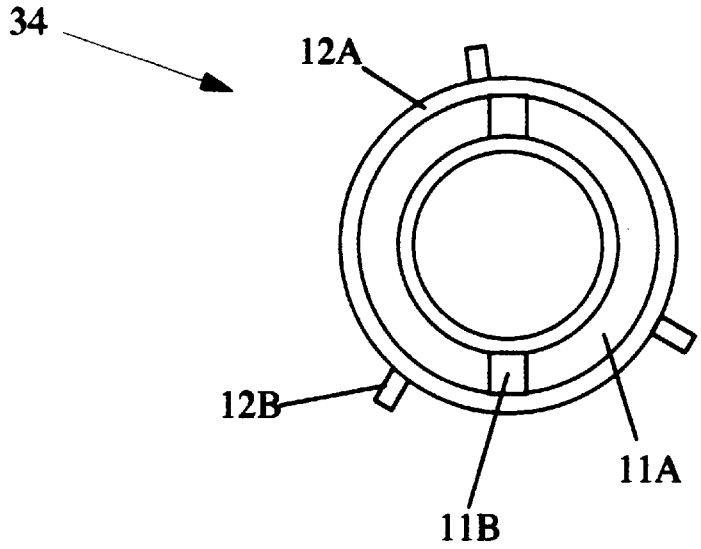
FIG. 3D shows the top view of the socket base assembly of the present invention.
Figure 3C:
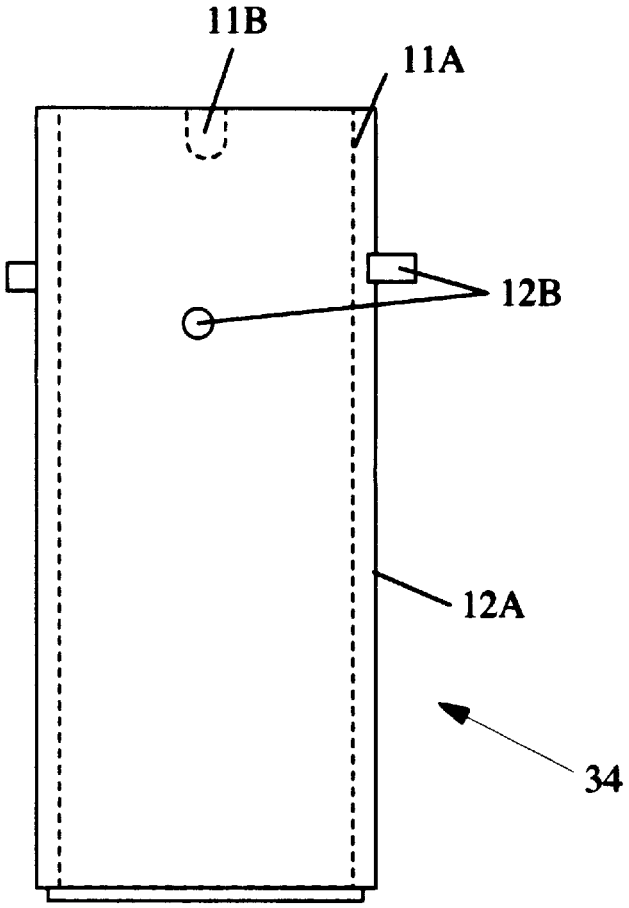
FIG. 3C shows the side view of the socket base assembly of the present invention.
Figure 6A:
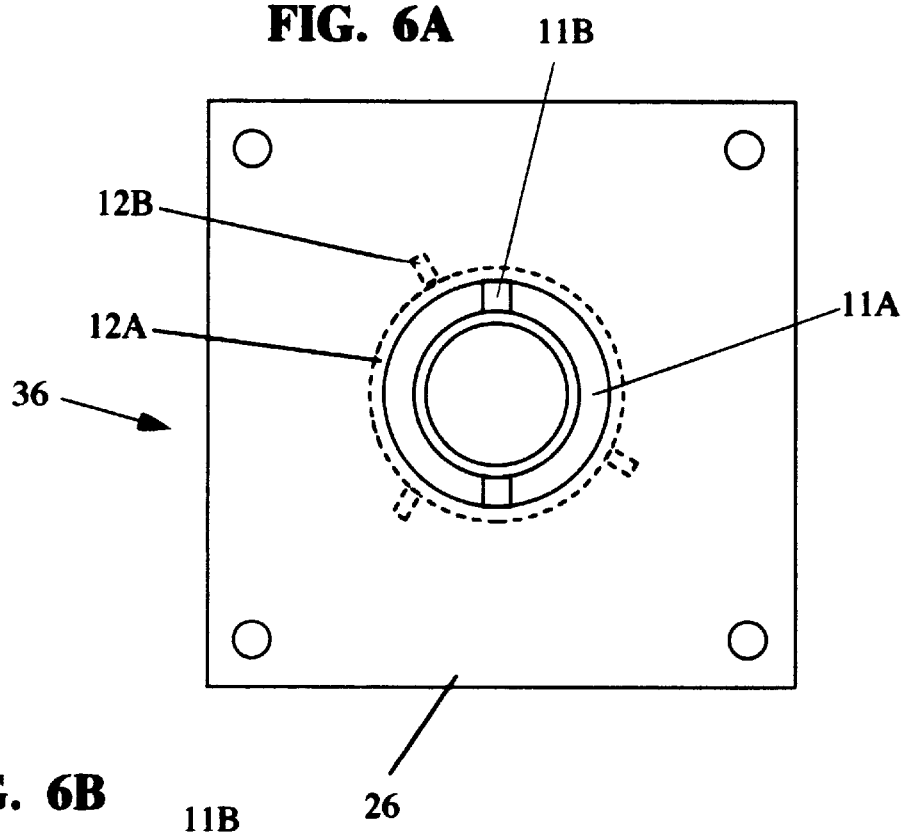
FIG. 6A shows the top view of the optional socket plate assembly of the present invention.
Figure 6B:
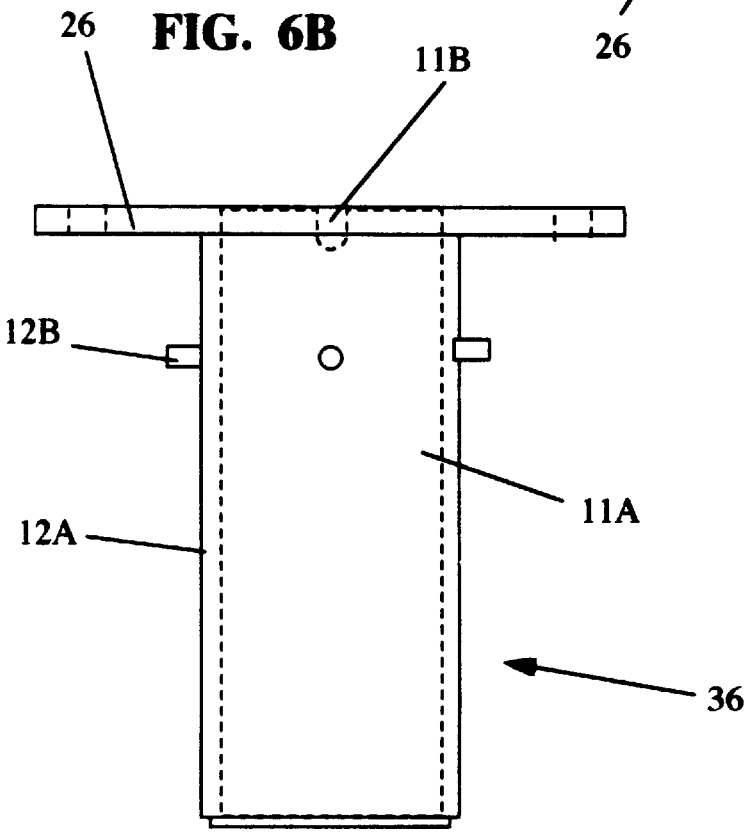
FIG. 6B shows the side view of the optional socket plate assembly of the present invention.

ROTATION LOCK—(FIGS. 1, 3A, and 3B)—The rotation lock assembly 35 consists of the foot/hand control 7 and the lock pin 8 which provides a system to prevent the seat 13 and lift assembly 33 (FIG. 1) from moving away from the user when mounting or dismounting the seat 13 in the water and over the deck. No springs are needed. The top end of the lock pin 8 is engaged by the hand/foot control 7 to raise the lock pin 8. The foot/hand control 7 pivot is off center to allow gravity to reposition the control after it has been released. The lock pin 8 also uses no springs. The lock pin 8, once raised up by the foot/hand control 7, is allowed to glide along the socket bearing 11A (FIGS. 3C and 3D), or optional socket plate assembly 36 (FIGS. 6A and 6B) or similar notched fixture, as the lift is rotated until the lock pin 8 drops into the notch 11B in the socket bearing 11A or optional socket plate assembly 36. Variations of this setup may also be used including but not limited to the use of spring type devices and varied remote control locations.

SOCKET BASE—(FIGS. 1, 3C, and 3D) The socket base assembly 34 consists of the socket 12A, anti-slip pins 12B, bearing 11A, and the notches 11B which provide the anchor point and bearing point for the lift assembly 33 (FIG. 1). The socket 12A is constructed of stainless steel or similar alloys with a socket bearing 11A which also provides the notches 11B for the rotation lock assembly 35. The outer walls of the socket 12A are affixed with anti-slip pins 12B to prevent the socket 12A from slipping in the typical concrete cavity with anchor cement. The anti-slip pins 12B also protrude into the socket bearing 11A to prevent rotation of the socket bearing 11A within the socket 12A when the rotation lock assembly 35 is engaged.

SOCKET PLATE BASE—(FIGS. 6A and 6B) The socket plate assembly 36 consists of socket plate 26 made from stainless steel or similar alloy plate with a hole/holes and the standard socket assembly 34 welded to the underside. The socket plate assembly 36 provides for the installation of the lift assembly 33 (FIG. 1) to wood decks, boat docks, boats decks, thin concrete slabs, and other varying situations.

CYLINDER—(FIGS. 1, 2B, and 2C) The cylinder 1A is constructed of round tubular material suitable for use. The cylinder 1A has the option of a PVC or similar material outer sleeve to serve as a protective barrier against dents and similar damage to the exterior of cylinder 1A which may be constructed of stainless steel. The cylinder 1A has a series of holes to accommodate the key pin 2 and valve assembly 3 connection via a valve plate 1B attached onto the cylinder 1A wall. The cylinder's 1A top end portion is built with extra length as a safety feature in case the key pin 2 were to dislodge. The extra length prevents the piston 19 from traveling beyond the top end of the cylinder 1A while the seat assembly 31 is in place if the key pin 2 were to become dislodged. Also, the extra length helps to prevent the need to replace the cylinder 1A due to damage that might occur if the top end of the cylinder 1A were to be dropped against the floor, etc. The extra length allows for the installation of a lift operation lock to prevent the lift from being used without authorization. The cylinder assembly 29 consists of the cylinder 1A, the key pin 2, the piston rod assembly 32, the valve assembly 3, and the valve plate 1B.

KEY GUIDE—(FIGS. 2A, 2B, and 2C) The shaped key 23 keeps piston rod 4 and seat assembly 31 from rotating freely. Allowing the assemblies to rotate freely would create an unsafe and uncontrolled upward and downward travel of the seat 13 and the user. The shaped key 23 is secured into place with the key pin 2 passing through a holes the cylinder 1A wall and the shaped key 23. The key 23 extends through the key guide 21 which is fitted to the inside of the top end of piston rod 4. Having the key guide 21 fitted to the inside of the piston rod 4 provides a safer and stronger reinforcement for the key guide 21 which helps to prevent the key guide from expanding thereby allowing the piston rod 4 and seat assembly 31 to slip around during use and under load to an undesirable position in an unsafe manner. The key guide 21 is secured inside the piston rod 4 with screws or similar fasteners 22 or pins and may be rectangular or square in order to prevent free rotation of the rod 4. Other designs rely on the piston itself which is not reinforced like the key guide 21 to prevent the piston rod 4 from rotating. The centering rod 25 prevents the key 23 from drifting off center of the cylinder 1A during the piston rod assembly's 32 upward and downward travel motion. Various shaped keys may be used depending on the application.

PISTON ROD—(FIGS. 1, 2A and 2C) Piston rod 4 is constructed with round tubing. The top end of piston rod 4 has the key guide 21 fitted inside it. The top end of piston rod 4 also has a retaining disc 20 attached (welded) and extending radially outward in order to provide a secure stop for the internal piston 19 and the downward or upward travel of the piston rod assembly 32 and seat assembly 31. The piston rod 4 does not rely on the piston 19 to act as a rotation guide and a down stop anchor point to stop the downward travel of the piston rod 4 against the spacer tube 18 as other designs do. The retainer disc 20 allows the piston 19 the option of not being attached to the piston rod via screws or similar fasteners which makes the lift assembly 33 safer. This safety feature is designed by not depending on the piston being properly secured to the piston rod, a failure of which would allow the entire piston rod and seat assembly to drop completely out of the a lift cylinder along with the user. This also allows for simpler, safer service, disassembly and assembly. The base of the piston rod 4 has a hole through it for the mounting of the seat assembly 31.

PISTON ROD ASSEMBLY—(FIG. 2A and 2C) The piston rod assembly 32 consists of the piston rod 4 with the attached disc retainer 20, piston 19 with upper rubber seal 17*a*, the spacer pipe 18, and the guide 16 with lower rubber seal 17*b*. The key guide 21 is secured inside the top end of the piston rod 4 by pins/screws with the key 23 extending downward through the key guide 21. The piston 19 is not required to be bolted or secured to the piston rod 4. The piston 19 is free to slide and rotate on the piston rod 4. As the water fills the cylinder 1A between upper rubber seal 17*a* and lower rubber seal 17*b*, piston 19 rises and engages retaining disc 20. Continued upward travel of the piston 19 and, concurrently, piston rod 4 forces the lower end of the rod 4 and seat assembly 31 to move vertically upward. As previously mentioned, key 23 which extends downward into the piston rod 4 prevents the rod and seat assembly from rotating freely.

SEAT ASSEMBLY—(FIGS. 1 and 5) The seat assembly 31 is constructed with a square/rectangular main support tube 15A with a series of holes to provide mounting locations to the piston rod 4, for the optional foot rest 28, the optional headrest 27, and other potential custom options. The seat mount 15B provides a base for the seat shell 13 to secure to. The grab handle/arm rest 14 is also part of the seat assembly 31.

Figure 7A:
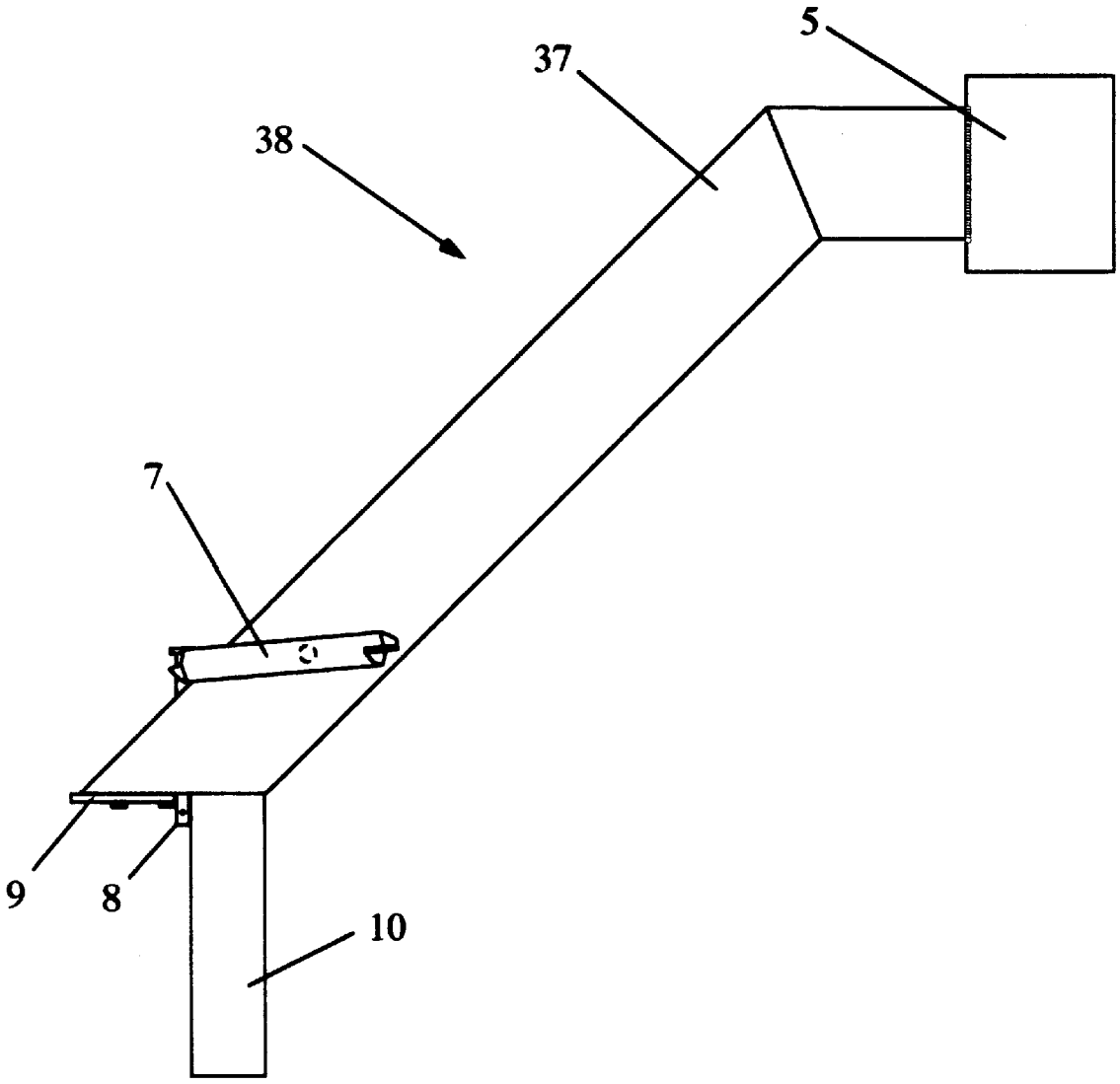
FIG. 7A shows the extended reach support beam assembly of the present invention; and, FIG. 7B shows an extended reach version of the lift assembly of the present invention using the extended reach support beam assembly.
Figure 7B:
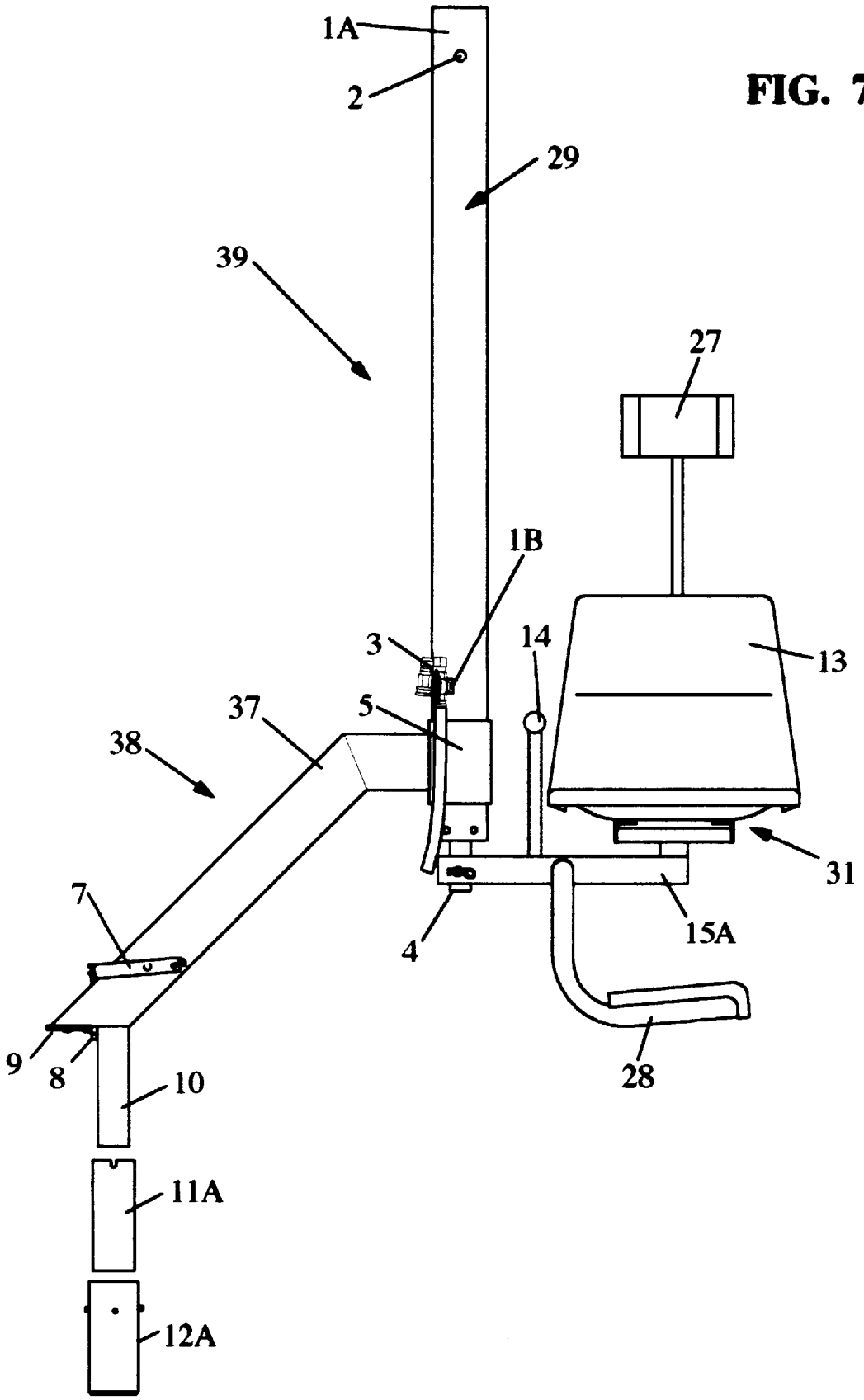

EXTENDED REACH SUPPORT BEAM ASSEMBLY—(FIGS. 7A and 7B) The extended reach support beam assembly 38 shares the same parts and components as the support beam assembly 30 with the exception of the extended reach support beam 37 having an extended tube toward the clamp 5. This allows the lift assembly 33 to be used in an application which requires a longer reach to clear obstacles to the targeted access area of the lift. The descriptions and functions of the support beam assembly 30 apply to the extended reach support beam assembly 38 as well.

EXTENDED REACH LIFT ASSEMBLY—(FIG. 7B) The extended lift assembly 39 is shown in (FIG. 7B) to illustrate the relationship of the cylinder assembly 29, and seat assembly 31 to the extended reach support beam assembly 38. The extended reach lift assembly 39 shares the same parts and components as the lift assembly 33 with the exception of the extended reach support beam 37 having an extended tube toward the clamp 5. This allows the lift assembly 33 to be used in an application which requires a longer reach to clear obstacles to the targeted access area of the lift. The descriptions and functions of the lift assembly 33 apply to the extended reach lift assembly 39 as well.

LIFT FUNCTION AND USE—(FIGS. 1, 2A, 2B, 2C, 3A, 3B, 3C, 3D, 4A, 4B, 5, 6A, and 6B) The purpose of the lift assembly 33 is to provide a means of access to a user from one location level and position to another. The lift assembly 33 consists of a support structure assembly 30 to the hydraulic action cylinder 1A which has a user support platform 13 attached to the piston rod 4. The lift assembly 33 obtains its power from a pressurized fluid source such as but not limited to a water input into a valve assembly 3. The valve assembly controls the direction of flow into and out of the cylinder 1A which in turn controls the upward and downward travel movement of the piston rod 4 and platform 13. As the valve assembly 3 allows the flow inward, the cylinder 1A fills between the inner seals 17*a* and 17*b* causing the upward movement of the piston rod 4 and platform 13. As the valve assembly 3 allows the flow outward, the cylinder 1A discharges the fluid causing the piston rod 4 and platform 13 to descend and causing the piston rod 4 and piston 19 to travel downward along key 23.

The lift assembly 33 is supported by an anchor socket base assembly 34 or socket plate assembly 36 in the ground or on a deck surface. This provides a point at which the lift assembly 33 can rotate 360° in either direction via a post 10. Post 10 extends downward from the base of the lift's support structure assembly 30 into the socket 12A and the socket's bearing 11A surface. The lift assembly 33 incorporates a rotation locking mechanism assembly 34 which locks the lift assembly's 33 rotation at the desired positions preventing the platform 13 from moving away from the user when mounting and dismounting the platform 13. A remote foot/hand control 7 disengages a locking pin 8 allowing the lift assembly 33 to be rotated to the next predetermined locking point at which the locking pin 8 engages preventing further rotation of the lift assembly 33 until the locking pin 8 is again disengaged. A user mounts the platform 13. The lift assembly 33 may then be rotated to the desired position and the user lowered and or raised to their targeted location.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A hydraulic chair lift, comprising, a single angular upwardly extending support beam;

a vertically extending cylinder assembly affixed at its lower end to an upper end of said support beam, said support beam adapted to be affixed to a horizontal surface at a lower end;

a piston rod movably retained within said cylinder assembly;

a seat assembly attached to said piston rod; and, a valve affixed to said cylinder assembly.

2. The hydraulic chair lift of claim 1 wherein said vertically extending cylinder assembly has an upper and a lower end, said support beam being removably attached to said cylinder assembly at said lower end.

3. The hydraulic chair lift of claim 2 wherein said piston rod extends downward from said lower end of said cylinder assembly.

4. The hydraulic chair lift of claim 1 wherein said support beam is rotatably affixed to the ground.

5. The hydraulic chair of claim 4 wherein said support beam is further comprised of:

a downwardly extending tube;

a socket bearing which receives said tube;

a socket;

wherein said socket is placed in the ground and receives said socket bearing and wherein said downwardly extending tube is securely inserted within said socket bearing.

6. The hydraulic chair lift of claim 5 further comprising a rotation lock mechanism for preventing said support beam from rotating when said lock mechanism is engaged.

7. The hydraulic chair lift of claim 6 wherein said rotation lock mechanism is comprised of:

a pivoting control pivotally attached to said support beam;

a lock pin attached to one end of said pivoting control.

8. The hydraulic chair lift of claim 1 wherein said support beam is removably attached to said cylinder assembly by a clamp.

9. The hydraulic chair lift of claim 1 wherein a pressurized water source is in flow communication with said valve means and said cylinder assembly.

10. The hydraulic chair lift of claim 1 wherein said cylinder assembly is further comprised of:

an exterior cylindrical housing to retain said cylinder assembly, said piston rod extending centrally through said exterior cylindrical housing;

a key guide securely retained within the interior of said piston rod;

a key which extends through said key guide and downward into said piston rod and is affixed at its top end to said exterior cylindrical housing, a retaining disc extending radially outward from the top end of said piston rod;

a floating piston which travels vertically with said piston rod and engages said retaining disc;

an upper seal directly below said floating piston;

a spacer pipe below said upper seal;

a lower seal below said spacer pipe;

a centering guide below said lower seal through which extends said piston rod;

wherein said floating piston is secured between said upper seal and said retaining disc and wherein said valve allows water to enter between said upper seal and said lower seal.

11. The hydraulic chair of claim 10 wherein said support beam is affixed to said cylinder assembly at a point near said lower seal.

12. A hydraulic chair lift comprised of:

an upwardly extending support beam;

a vertically extending cylinder assembly affixed at its lower end to said support beam, said support beam adapted to be affixed to a horizontal surface at the opposite end;

a seat assembly vertically movable along said cylinder assembly;

valve means affixed to said cylinder assembly;

a rotation lock mechanism for preventing said support beam from rotating when said lock mechanism is engaged.

13. The hydraulic chair lift of claim 12 wherein said rotation lock mechanism is comprised of:

a pivoting control pivotally attached to said support beam;

a lock pin attached to one end of said pivoting control.

14. The hydraulic chair lift of claim 13 wherein said rotation lock mechanism is further comprised of a socket bearing having notches thereon which receive said lock pin to retain said support beam in position.

15. The hydraulic chair lift of claim 12 wherein said rotation lock mechanism is comprised of a socket plate and said support beam further has a tube extending downward therefrom, said socket plate having a socket assembly depending therebelow, said socket assembly receiving said tube.

16. A cylinder assembly for a hydraulic chair lift, comprising:

an exterior cylinder housing;

a piston rod extending centrally through said exterior cylindrical housing and having a radially extending retaining disc at its top end;

a key guide secured within Me interior of said piston rod;

a key which extends through said key guide and downward into said piston rod and affixed at its top end to said exterior cylindrical housing, a floating piston which travels vertically with said piston rod and engages said retaining disc;

an upper seal directly below said floating piston;

a spacer pipe below upper seal;

a lower seal below said spacer pipe; and, valve means affixed to said cylinder assembly between said upper seal and said lower seal.

17. The cylinder assembly of claim 16 wherein said floating piston is secured between said upper seal and said retaining disc and wherein said valve allows water to enter between said upper seal and said lower seal.

18. The cylinder assembly of claim 16 further comprising at least one spacer pipe between said upper and lower seal.

19. The cylinder assembly of claim 16 wherein said key and said key guide is square.

* * * * *